US007856720B2

(12) United States Patent
Okaniwa

(10) Patent No.: US 7,856,720 B2
(45) Date of Patent: Dec. 28, 2010

(54) HAIR BRUSH AND REPLACEABLE CUTTING UNIT FOR HAIR BRUSH

(75) Inventor: Hisao Okaniwa, Nagano (JP)

(73) Assignee: Japan Lanka Trading Co., Ltd., Nagano (JP)

( * ) Notice: Subject to any disclaimer, the term of this patent is extended or adjusted under 35 U.S.C. 154(b) by 153 days.

(21) Appl. No.: 11/548,227

(22) Filed: Oct. 10, 2006

(65) Prior Publication Data

US 2007/0199572 A1 Aug. 30, 2007

Related U.S. Application Data

(63) Continuation of application No. 10/689,354, filed on Oct. 20, 2003, now Pat. No. 7,243,428.

(30) Foreign Application Priority Data

Oct. 25, 2002 (JP) ..... 2002-311807

(51) Int. Cl.
*B26B 21/42* (2006.01)

(52) U.S. Cl. ..... 30/30; 30/34.05

(58) Field of Classification Search ..... 30/30, 30/31, 34.05, 50, 53–55; 15/207.2
See application file for complete search history.

(56) References Cited

U.S. PATENT DOCUMENTS

| | | | | | |
|---|---|---|---|---|---|
| 1,739,214 | A | * | 12/1929 | Darling | 452/147 |
| 1,829,667 | A | * | 10/1931 | Mirafuentes | 30/31 |
| 2,610,393 | A | | 9/1952 | Hammond | |
| 3,002,319 | A | | 10/1961 | Laughlin | 47/57.5 |
| 3,165,831 | A | * | 1/1965 | Carrol | 30/30 |
| 3,395,742 | A | * | 8/1968 | Sanders | 83/698.41 |
| 3,750,285 | A | | 8/1973 | Mechelson | 30/346.58 |
| 3,990,461 | A | | 11/1976 | Katz | |
| 4,020,549 | A | | 5/1977 | Edwards | |
| 4,037,322 | A | | 7/1977 | Bresler | 30/53 |
| 4,211,006 | A | | 7/1980 | Halaby et al. | 30/346.55 |
| 4,346,721 | A | | 8/1982 | Molaro | |
| 5,522,137 | A | * | 6/1996 | Andrews | 30/50 |
| 5,794,348 | A | | 8/1998 | Scott | |
| 5,884,402 | A | | 3/1999 | Talavera | 30/124 |
| 6,041,467 | A | | 3/2000 | Roberts et al. | |
| 6,161,288 | A | | 12/2000 | Andrews | |
| 6,792,642 | B2 | | 9/2004 | Wagstaff | |
| 7,243,428 | B2 | | 7/2007 | Okaniwa | |
| 2003/0208865 | A1 | | 11/2003 | Davies | |
| 2006/0130334 | A1 | | 6/2006 | Park | |

FOREIGN PATENT DOCUMENTS

| | | |
|---|---|---|
| FR | 2 457 088 A1 | 12/1980 |

(Continued)

*Primary Examiner*—Kenneth E. Peterson
(74) *Attorney, Agent, or Firm*—Oliff & Berridge, PLC

(57) ABSTRACT

The object of the present invention is to provide a hair brush that can be used for cutting the hair so that no skills and knack are required for adjusting the inclination angle of bristles and cutters with respect to the scalp. In a hair brush in which multiple the bristles 12 are set upright on a the brush body 14, the cutters 18 provided with the cutting edges 18*a* are set upright nearby the bristles 12.

6 Claims, 10 Drawing Sheets

FOREIGN PATENT DOCUMENTS

| | | |
|---|---|---|
| JP | U-50-77084 | 7/1975 |
| JP | 51-9966 | 1/1976 |
| JP | U-51-9966 | 1/1976 |
| JP | U-57-36142 | 8/1980 |
| JP | 60-103402 | 7/1985 |
| JP | U-60-103402 | 7/1985 |
| JP | U-4-112377 | 9/1992 |
| JP | 5-88479 | 12/1993 |
| JP | U-6-72504 | 10/1994 |
| JP | 9-38356 | 2/1997 |
| JP | A-2003-111985 | 4/2003 |

* cited by examiner

HAIR BRUSH AND REPLACEABLE CUTTING UNIT FOR HAIR BRUSH

CROSS-REFERENCE TO THE RELATED APPLICATIONS

This is a continuation of the application Ser. No. 10/689,354 filed Oct. 20, 2003 now U.S. Pat. No. 7,243,428, the entire contents of which are incorporated by reference. This application also claims benefit of priority under 35 U.S.C. §119 to Japanese Application No. 2002-311807 filed Oct. 25, 2002, the entire contents of which are incorporated by reference.

BACKGROUND OF THE INVENTION

1. Field of the Invention

The present invention relates to a hair brush provided with a hair cutting function, a hair combing function, and a scalp massaging function, and to a replaceable cutting unit for a hair brush that can be used in such a hair brush.

2. Description of the Related Art

Hair styling is widely conducted with the object of hair beautification by combing the hair and partially cutting the excess hair, while massaging the scalp.

In such an operation, combing and cutting of the hair have been conventionally conducted by using the hairdresser's scissors and combs as separate tools according to the object of the operation.

It is also known that hair brushes were used with the object of massaging the scalp, while adjusting the hair.

However, with the above-described prior art technology, a hair brush was required in addition to the hairdresser's scissors and comb, and the drawback of the operation was that because skills and a knack were necessary, the operation was difficult to conduct.

Japanese Utility Model Application Laid-open No. S51-9966 disclosed a hair brush 70 designed to resolve those problems.

With this prior art technology, a hair brush body 72 was provided with three rows of bristles 74, cutters 76 with the cutting edges 76*a* turned away from the hair brush body 72 were provided on the hair brush body 72 between the bristles 74, and the height of the cutters 76 was set lower than that of the bristles 74 (see FIGS. 12 and 13).

SUMMARY OF THE INVENTION

With the above-described prior art technology described in Japanese Utility Model Application Laid-open No. S51-9966, cutters 76 with a height lower than that of the bristles 74 were provided. Therefore, it can be imagined that the hair cutting function, hair combing function and scalp massaging function were provided without the risk of hurting the scalp with the cutters 76. However, the following problems were associated with this technology.

The cutters 76 of the prior art technology, as shown in FIG. 13, are set upright on the hair brush body 72 parallel to the bristles 74.

Therefore, at time of use, the cutting edges 76*a* of the cutters 76 are turned at a right angle to hair H (see FIG. 14).

Thus, the hair combing operation and scalp massaging can be conducted by bristles 74, and hair H can be cut by cutters 76; however, because the cutting edges 76*a* of the cutters 76 move in a direction perpendicular to hair H, hair H is cut excessively in an amount exceeding the desired amount. Moreover, stepwise hair cutting occurs, as shown in FIG. 14.

As a result, the so-called "unevenly-cropped" state is obtained and a decisive problem of the hair unevenness is encountered.

It is an object of the present invention to resolve the problems inherent to the above-described prior art configurations and to provide a hair brush capable of conducting hair cutting together with hair combing and scalp massaging by a single operation, the hair cutting requiring no skills and knack for adjusting the inclination angle of bristles and cutters with respect to the scalp.

Another object of the present invention is to provide a hair brush excellent in safety, which creates no risk of the scalp being scratched by the cutters at the time of use.

Other objects of the present invention are described hereinbelow.

Thus, yet another object of the present invention is to provide a hair brush which causes no "uneven cropping" when the hair is cut.

Other objects are to provide a hair brush in which the cutters can be replaced according to the usage-induced deterioration of cutters, to provide a hair brush that can increase greatly the cutting amount of the hair, and to provide a hair brush in which the hair can be smoothly introduced between the cutters and bristles.

It is another object of the present invention to provide a replaceable cutting unit for a hair brush, which can cut the hair at the scalp side.

Other objects relating to the replaceable cutting unit for a hair brush have much in common with the objects relating to the hair brush, and thus shall be explained by making reference to those objects relating to the hair brush.

Other objects relating to the hair brush, as well as other objects relating to the replaceable cutting unit, will become apparent from the following description, taken in conjunction with the accompanying drawings.

In the $1^{st}$ means for resolving the problems, in a hair brush in which multiple bristles are set upright on a brush body, cutters comprising cutting edges are set upright nearby the bristles.

The term "bristles" as referred to in the present specification relates to a variety of objects set upright on the brush body, for example, brush teeth, combing teeth, brush bristles, comb teeth, and the like, and has the same meaning as those terms.

The bristles are typically in the form of elongated pins and may have a round shape or other shape, provided that it has no angles.

Further, it goes without saying that bundles with a circular cross-section consisting of a large number of animal bristles such as hog bristles also fall under this definition of bristles.

Further, the expression "the cutters comprising cutting edges are set upright nearby the bristles" means not only that the cutters are adjacent to the bristles, but also that the cutters may be set upright on the brush body at a distance from the bristles located nearby, rather than adjacently thereto.

In the $2^{nd}$ means for resolving the problems, the cutting edges of the cutters are arranged so as to face the bristles in the $1^{st}$ means for resolving the problems.

In the $3^{rd}$ means for resolving the problems, the cutters are set upright in a specific region of the brush body in the $1^{st}$ or $2^{nd}$ means for resolving the problems.

In the $4^{st}$ means for resolving the problems, the cutters are arranged so as to face the adjacent bristles in the $1^{st}$, $2^{nd}$ or $3^{rd}$ means for resolving the problems.

In the $5^{th}$ means for resolving the problems, the height of the cutting edges of the cutters is set lower than the height of the bristles in the $1^{st}$, $2^{nd}$, $3^{rd}$ or $4^{th}$ means for resolving the problems.

In the $6^{th}$ means for resolving the problems, the height of the cutting edges of the cutters is roughly equal to the height of the bristles, and protective members for the scalp are provided on the upper end of the cutters in the $1^{st}$, $2^{nd}$, $3^{rd}$ or $4^{th}$ means for resolving the problems.

In the $7^{th}$ means for resolving the problems, the cutters and bristles are inclined so as to come apart gradually, increasing the distance therebetween, in the upward and outward directions in the $1^{st}$, $2^{nd}$, $3^{rd}$, $4^{th}$, $5^{th}$ or $6^{th}$ means for resolving the problems.

In the $8^{th}$ means for resolving the problems, the cross section of the bristles adjacent to the cutters on the cutting edge side of the cutters is at least in the form of a circular arc in the $1^{st}$, $2^{nd}$, $3^{rd}$, $4^{th}$, $5^{th}$, $6^{th}$ or $7^{th}$ means for resolving the problems.

In the $9^{th}$ means for resolving the problems, a cover with an approximately U-shaped cross section is provided, the cutting edge of the cutter is accommodated inside the cover so as to be exposed through an opening in the cover, and projections protruding slightly beyond the extension line of the cutting edge in the direction perpendicular to the extension line of the cutting edge of the cutter are provided with a constant spacing in the cover in the $1^{st}$, $2^{nd}$, $3^{rd}$, $4^{th}$, $5^{th}$, $6^{th}$, $7^{th}$ or $8^{th}$ means for resolving the problems.

In the $10^{th}$ means for resolving the problems, a replaceable cutting unit for a hair brush in which bristles are set upright in a cutting unit base, the cutters provided with cutting edges are set upright nearby the bristles, and the cutting edges of the cutters are arranged so as to face the bristles is provided so that it can be attached to the brush body and detached therefrom in the $1^{st}$, $2^{nd}$, $3^{rd}$, $4^{th}$, $5^{th}$, $6^{th}$, $7^{th}$, $8^{th}$ or $9^{th}$ means for resolving the problems.

In the $11^{th}$ means for resolving the problems, the cutter is provided so that it can be attached to the brush body and detached therefrom in the $1^{st}$, $2^{nd}$, $3^{rd}$, $4^{th}$, $5^{th}$, $6^{th}$, $7^{th}$, $8^{th}$, $9^{th}$ or $10^{th}$ means for resolving the problems.

In the $12^{th}$ means for resolving the problems, a fitting hole is provided in the brush body and the cutting unit base of the replaceable cutting unit for a hair brush is configured so as to correspond to the fitting hole in the $1^{st}$, $2^{nd}$, $3^{rd}$, $4^{th}$, $5^{th}$, $6^{th}$, $7^{th}$, $8^{th}$, $9^{th}$, $10^{th}$ or $11^{th}$ means for resolving the problems.

In the $13^{th}$ means for resolving the problems, bristles also serving as holding members for the cutters, on which the cutters are mounted, and bristles not provided with cutters are set upright on the brush body, and the cutting edges of the cutters are arranged so as to face the bristles not provided with cutters in the $1^{st}$, $2^{nd}$, $3^{rd}$, $4^{th}$, $5^{th}$, $6^{th}$, $7^{th}$, $8^{th}$, $9^{th}$, $10^{th}$, $11^{th}$ or $12^{th}$ means for resolving the problems.

In the $14^{th}$ means for resolving the problems, in a hair brush in which multiple bristles are set upright on a brush body, cutters with a height less than the height of the bristles are provided in a certain region of the brush body between the bristles, and the cutting edges of the cutters are directed to the outside of the brush body and are arranged in a state of separation from the brush body.

All the $15^{th}$ through $25^{th}$ means for resolving the problems represent the invention relating to a replaceable cutting unit for a hair brush.

In the $15^{th}$ means for resolving the problems, bristles are set upright in a cutting unit base, and cutters comprising cutting edges are set upright nearby the bristles.

In the $16^{th}$ means for resolving the problems, the bristles are set upright in a cutting unit base, the cutters comprising cutting edges are set upright nearby the bristles, and the cutting edges of the cutters are disposed so as to face the bristles in the $1^{th}$ means for resolving the problems.

In the $17^{th}$ means for resolving the problems, the cutters are set upright in a cutting unit base.

In the $18^{th}$ means for resolving the problems, the cutting edges of the cutters are disposed so as to face the adjacent bristles in the $15^{th}$ or $16^{th}$ means for resolving the problems.

In the $19^{th}$ means for resolving the problems, the height of the cutting edges of the cutters is set lower than the height of the bristles in the $15^{th}$, $16^{th}$ or $18^{th}$ means for resolving the problems.

In the $20^{th}$ means for resolving the problems, the height of the cutting edges of the cutters is roughly equal to the height of the bristles, and a protective member for the scalp is provided on the upper end of each cutter in the $15^{th}$, $16^{th}$ or $18^{th}$ means for resolving the problems.

In the $21^{st}$ means for resolving the problems, the cutters and bristles are inclined so as to come apart gradually, increasing the distance therebetween, in the upward and outward directions in the $15^{th}$, $16^{th}$, $18^{th}$, $19^{th}$ or $20^{th}$ means for resolving the problems.

In the $22^{nd}$ means for resolving the problems, the cross section of the bristles adjacent to the cutters on the cutting edge side of the cutters is at least in the form of a circular arc in the $15^{th}$, $16^{th}$, $18^{th}$, $19^{th}$, $20^{th}$ or $21^{st}$ means for resolving the problems.

In the $23^{rd}$ means for resolving the problems, a cover with an approximately U-shaped cross section is provided, the cutting edge of the cutter is accommodated inside the cover so as to be exposed through an opening in the cover, and projections protruding slightly beyond the extension line of the cutting edge in the direction perpendicular to the extension line of the cutting edge of the cutter are provided with a constant spacing in the cover in the $15^{th}$, $16^{th}$, $17^{th}$, $18^{th}$, $19^{th}$, $20^{th}$, $21^{st}$ or $22^{nd}$ means for resolving the problems.

In the $24^{th}$ means for resolving the problems, bristles also serving as holding members for cutters, on which cutters are mounted, and bristles not provided with the cutters are set upright on a cutting unit base, and the cutting edges of the cutters are disposed so as to face the bristles not provided with the cutters in the cover in the $15^{th}$, $16^{th}$, $17^{th}$, $18^{th}$, $19^{th}$, $20^{th}$, $21^{st}$, $22^{nd}$ or $23^{rd}$ means for resolving the problems.

In the $25^{th}$ means for resolving the problems, a pair of support members for a cutter are set upright with a constant spacing therebetween on a cutting unit base, and a cutting edge of the cutter is disposed between the pair of support members for a cutter so as to be directed outward of the cutting unit base and to be separated from the cutting unit base.

The $1^{st}$ means for resolving the problems has the above-described configuration and, therefore, demonstrates the following operation effect.

The bristle side of the brush is typically moved, with the bristles facing the hair, along the scalp from the top of the head to the neck.

In this case, in the comb of the prior art technology, the comb teeth were in linear contact with the scalp. Therefore, it was necessary to hold the comb teeth at the prescribed inclination angle. However, this operation of maintaining the inclination angle required skills or knack and was unavoidably difficult.

By contrast, in accordance with the present invention, because multiple bristles are provided, it is not important that the inclination angle of the bristles be adjusted and the bristles can be conveniently used by simply bringing them in contact with the scalp.

Because multiple bristles are provided, surface contact can be attained by simply bringing the bristle groups of the hair brush into contact with the scalp.

Therefore, a difficult and complex operation of adjusting the inclination angle of the bristles, as in the prior art technology, is unnecessary. Moreover, because the posture of the brush during hair cutting can be kept constant, the operations of hair cutting and combing and scalp massaging can be conducted evenly.

Moreover, in accordance with the present invention, because the cutters are set upright nearby the bristles, by contrast with the prior art technology in which the hair is cut by moving the cutters in a direction perpendicular to the hair, cutting of the hair is carried out by moving the cutters in a direction parallel to the hair, that is, in the linear direction of the hair.

More specifically, the hair is introduced in a bundled state, while being combed with the bristles, between the bristles and the cutters set upright nearby the bristles In this case, the introduced group of hairs, for example, straight hairs in the case of Japanese people, in theory can be assumed to be positioned parallel to the bristles and cutting edges of the cutters. However, in reality, as was confirmed by the inventor, the movement of the bristles and cutting edges of the cutters is controlled by the movement of the human hand and the round shape of the scalp, which in combination with the effect of the group of hairs that are introduced in a bundled state cause the hair to intersect slightly the cutting edges of the cutters, rather than to be positioned parallel to the bristles and cutting edges of the cutters.

Here, because the brush is moved in a state in which the cutting edges and the hair intersect, the hair is combed by the cutting edges of the cutters and cut gradually by the cutting edges brought into contact with the hair.

In this case, uneven cropping does not occur because the cutting edges of the cutters are smoothly brought into contact with the hair, without describing a step-like path (see FIG. 5).

Therefore, in the prior art technology, because the cutting edges of the cutters moved in a direction perpendicular to the hair, they tended to cut the hair locally and there was the risk of forming steps in the hair. By contrast, in accordance with the present invention, as was described hereinabove, because hair intersecting the cutting edges is cut by the cutting edges, as though being combed thereby, the hair can be cut evenly, without the risk of cutting the hair locally.

The $2^{nd}$ means for resolving the problems has the above-described configuration and, therefore, demonstrates the following operation effect.

In addition to the operation effect demonstrated by the $1^{st}$ means for resolving the problems, because the cutting edges of the cutters are disposed so as to face the bristles, the hair introduced in the form of a bundle can be cut even more easily.

The $3^{rd}$ means for resolving the problems has the above-described configuration and, therefore, demonstrates the following operation effect.

In addition to the operation effect demonstrated by the $1^{st}$ or $2^{nd}$ means for resolving the problems, because the cutters comprising cutting edges are set upright only in a specific region, rather than over the entire area of the brush body, excessive cutting of hair can be controlled.

The $4^{th}$ means for resolving the problems has the above-described configuration and, therefore, demonstrates the following operation effect.

In addition to the operation effect demonstrated by the $1^{st}$, $2^{nd}$ or $3^{rd}$ means for resolving the problems, because the cutting edges of the cutters are disposed so as to face the adjacent bristles, the hair introduced between the bristles adjacent to the cutters is cut easily.

The $5^{th}$ means for resolving the problems has the above-described configuration and, therefore, demonstrates the following operation effect.

In addition to the operation effect demonstrated by the $1^{st}$, $2^{nd}$, $3^{rd}$ or $4^{th}$ means for resolving the problems, a metal material is typically used for the cutters and a material with a comparatively high softness such as a plastic or animal bristles is most often employed as a material for bristles.

Because the height of the cutting edges of the cutters is set lower than the height of the bristles, when the hair brush is used, owing to the physical properties of the bristle material, the bristles obviously cause no damage to the scalp even when brought into contact therewith. Because the upper end of the cutter is not brought into contact with the scalp, there is no risk of hurting the scalp with the cutters.

The $6^{th}$ means for resolving the problems has the above-described configuration and, therefore, demonstrates the following operation effect.

In addition to the operation effect demonstrated by the $1^{st}$, $2^{nd}$, $3^{rd}$ or $4^{th}$ means for resolving the problems, though the height of the cutting edges of the cutters is roughly equal to the height of the bristles, because a protective member for the scalp is provided at the upper end of each cutter, there is no risk of hurting the scalp with the cutter.

The $7^{th}$ means for resolving the problems has the above-described configuration and, therefore, demonstrates the following operation effect.

In addition to the operation effect demonstrated by the $1^{st}$, $2^{nd}$, $3^{rd}$, $4^{th}$, $5^{th}$ or $6^{th}$ means for resolving the problems, because the cutters and bristles are inclined so as to come apart gradually, increasing the distance therebetween, in the upward and outward directions, the amount of the hair introduced between the cutters and the bristles can be increased and cutting of thick hair is facilitated.

The $8^{th}$ means for resolving the problems has the above-described configuration and, therefore, demonstrates the following operation effect.

In addition to the operation effect demonstrated by the $1^{st}$, $2^{nd}$, $3^{rd}$, $4^{th}$, $5^{th}$, $6^{th}$ or $7^{th}$ means for resolving the problems, because the cross section of the bristles on the cutting edge side of the cutter is at least in the form of a circular arc, hair can be introduced smoothly.

The $9^{th}$ means for resolving the problems has the above-described configuration and, therefore, demonstrates the following operation effect.

In addition to the operation effect demonstrated by the $1^{st}$, $2^{nd}$, $3^{rd}$, $4^{th}$, $6^{th}$, $7^{th}$ or $8^{th}$ means for resolving the problems, not only can the cover strength be increased, but because the projections are provided with a constant spacing, hair introduced between the cutters and the bristles can be split by the projections, thereby preventing the hair from being cut excessively.

The $10^{th}$ means for resolving the problems has the above-described configuration and, therefore, demonstrates the following operation effect.

In addition to the operation effect demonstrated by the $1^{st}$, $2^{nd}$, $3^{rd}$, $4^{th}$, $5^{th}$, $6^{th}$, $7^{th}$, $8^{th}$ or $9^{th}$ means for resolving the problems, because a replaceable cutting unit for a hair brush in which the cutting edge of the cutter is disposed so as to face the bristles is provided so that it can be attached to the brush body and detached therefrom, the cutter can be replaced according to the usage-induced deterioration thereof.

Moreover, because the replaceable cutting unit for a hair brush comprises bristles and the cutting edge of the cutter is arranged so as to face the bristles, less time is required for arranging the cutting edge of the cutter to face the bristles when the replaceable cutting unit for a hair brush is replaced.

The $11^{th}$ means for resolving the problems has the above-described configuration and, therefore, demonstrates the following operation effect.

In addition to the operation effect demonstrated by the $1^{st}$, $2^{nd}$, $3^{rd}$, $4^{th}$, $5^{th}$, $6^{th}$, $7^{th}$, $8^{th}$, $9^{th}$ or $10^{th}$ means for resolving the problems, because the cutting unit is provided so that it can be attached and detached, the cutter can be replaced according to the usage-induced deterioration thereof.

The $12^{th}$ means for resolving the problems has the above-described configuration and, therefore, demonstrates the following operation effect.

In addition to the operation effect demonstrated by the $1^{st}$, $2^{nd}$, $3^{rd}$, $4^{th}$, $5^{th}$, $6^{th}$, $7^{th}$, $8^{th}$, $9^{th}$, $10^{th}$ or $11^{th}$ means for resolving the problems, because the cutting unit base of the replaceable cutting unit for a hair brush can be installed in the fitting hole in the brush body and the replaceable cutting unit for a hair brush can be removed from the fitting hole, the mounting structure of the replaceable cutting unit for a hair brush can be simplified.

The $13^{th}$ means for resolving the problems has the above-described configuration and, therefore, demonstrates the following operation effect.

In addition to the operation effect demonstrated by the $1^{st}$, $2^{nd}$, $3^{rd}$, $4^{th}$, $5^{th}$, $6^{th}$, $7^{th}$, $8^{th}$, $9^{th}$, $10^{th}$, $11^{th}$ or $12^{th}$ means for resolving the problems, because the cutters and bristles are inclined so as to come apart gradually, increasing the distance therebetween, in the upward and outward directions, the amount of the hair introduced between the cutters and the bristles can be increased and cutting of thick hair is facilitated.

Because the $14^{th}$ means for resolving the problems has the above-described configuration, cutting edges can be provided on both sides of a cutter, thereby improving the convenience of usage.

Furthermore, because cutters are disposed so as to be separated from the brush body, cut hairs can be discarded through the space formed above and below the cutters, thereby preventing the cutters from getting clogged with cut hair.

The $15^{th}$ means for resolving the problems has the above-described configuration and, therefore; demonstrates the following operation effect.

The operation effect is the same as the operation effect demonstrated by the $1^{st}$ means for resolving the problems, except that a cutting unit base can be replaced when the cutter of the brush body has deteriorated.

The $16^{th}$ means for resolving the problems has the above-described configuration and, therefore, demonstrates the following operation effect.

In addition to the operation effect demonstrated by the $15^{th}$ means for resolving the problems, because the cutting edges of the cutters are arranged so as to face the bristles, attaching the replaceable cutting unit for a hair brush to the brush body makes it possible to obtain an operation effect identical to that of the 2V means for resolving the problems.

The $17^{th}$ means for resolving the problems has the above-described configuration and, therefore, demonstrates an operation effect identical to that of the $15^{th}$ means for resolving the problems.

The $18^{th}$ means for resolving the problems has the above-described configuration and, therefore, demonstrates the following operation effect.

A replaceable cutting unit for a hair brush can be provided which makes it possible to obtain an operation effect identical to that of the $4^{th}$ means for resolving the problems, in addition to the operation effect demonstrated by the $15^{th}$ or $16^{th}$ means for resolving the problems.

The $19^{th}$ means for resolving the problems has the above-described configuration and, therefore, demonstrates the following operation effect.

A replaceable cutting unit for a hair brush can be provided which makes it possible to obtain an operation effect identical to that of the $5^{th}$ means for resolving the problems at the time of use, in addition to the operation effect demonstrated by the $15^{th}$, $16^{th}$, $17^{th}$ or $18^{th}$ means for resolving the problems.

The $20^{th}$ means for resolving the problems has the above-described configuration and, therefore, demonstrates the following operation effect.

In addition to the operation effect demonstrated by the $15^{th}$, $16^{th}$ or $18^{th}$ means for resolving the problems, an operation effect identical to an operation effect identical to that of the $6^{th}$ means for resolving the problems can be obtained at the time of use.

The $21^{st}$ means for resolving the problems has the above-described configuration and, therefore, demonstrates the following operation effect.

In addition to the operation effect demonstrated by the $15^{th}$, $16^{th}$, $18^{th}$, $19^{th}$ or $20^{th}$ means for resolving the problems, an operation effect identical to an operation effect identical to that of the $7^{th}$ means for resolving the problems can be obtained.

The $22^{nd}$ means for resolving the problems has the above-described configuration and, therefore, demonstrates the following operation effect.

In addition to the operation effect demonstrated by the $15^{th}$, $16^{th}$, $18^{th}$, $19^{th}$, $20^{th}$ or $21^{st}$ means for resolving the problems, an operation effect identical to that of the $8^{th}$ means for resolving the problems can be obtained.

The $23^{rd}$ means for resolving the problems has the above-described configuration and, therefore, demonstrates the following operation effect.

In addition to the operation effect demonstrated by the $15^{th}$, $16^{th}$, $18^{th}$, $19^{th}$, $20^{th}$, $21^{st}$, or $22^{nd}$ means for resolving the problems, an operation effect identical to an operation effect identical to that of the $9^{th}$ means for resolving the problems can be obtained.

The $24^{th}$ means for resolving the problems has the above-described configuration and, therefore, demonstrates the following operation effect.

In addition to the operation effect demonstrated by the $15^{th}$, $16^{th}$, $18^{th}$, $19^{th}$, $20^{th}$, $21^{st}$, $22^{nd}$ or $23^{rd}$ means for resolving the problems, an operation effect identical to that of the $13^{th}$ means for resolving the problems can be obtained.

The $25^{th}$ means for resolving the problems has the above-described configuration and, therefore, demonstrates the following operation effect.

Attaching the replaceable cutting unit for a hair brush in accordance with the $25^{th}$ means for resolving the problems to the brush body makes it possible to demonstrate an operation effect identical to that of the $14^{th}$ means for resolving the problems.

DESCRIPTION OF THE PREFERRED EMBODIMENT

Figure 1:
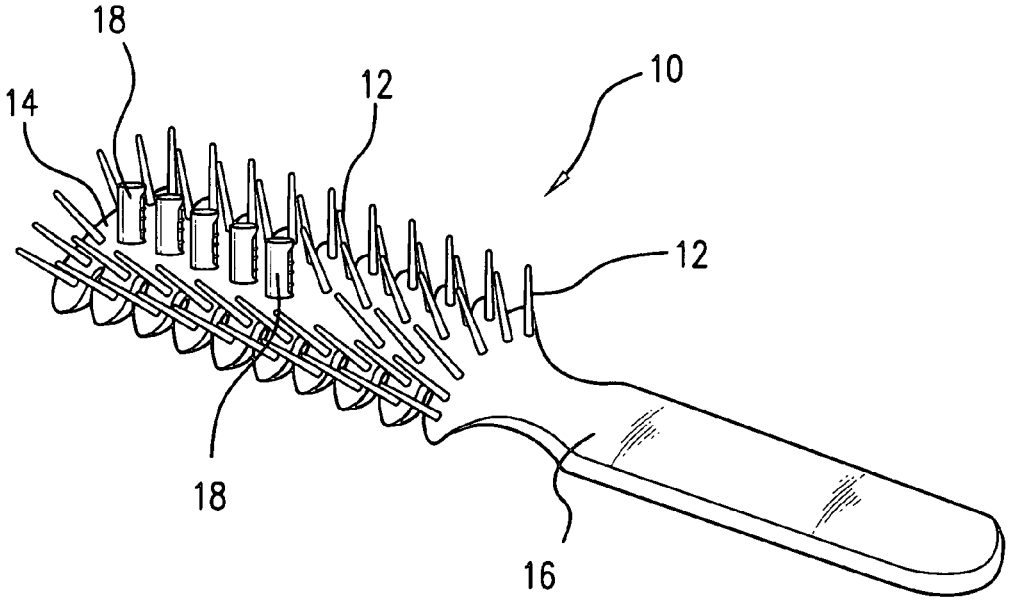
FIG. 1 is an oblique view of a hair brush of an embodiment of the present invention.

The invention relating to a hair brush 10 and replaceable cutting unit 20 for a hair brush according to an embodiment of the present invention will be described below with reference to the drawings.

The present invention relates to a combination of a well-known hair brush and cutters for cutting hair, and makes it possible to cut excess hair while combing the hair.

The hair brush 10 of Embodiment 1 will be described below.

In the present embodiment, the following hair brushes will be considered: (1) a hair brush 10 in which cutters 18 are fixed to a brush body 14; (2) a hair brush 10 in which a replaceable cutting unit 20 for a hair brush comprising bristles 12 and cutters 18 is provided detachably on the brush body 14; and (3) a hair brush 10 in which a replaceable cutting unit for a hair brush comprising only a cutter is provided detachably on the brush body 14.

Figure 2:
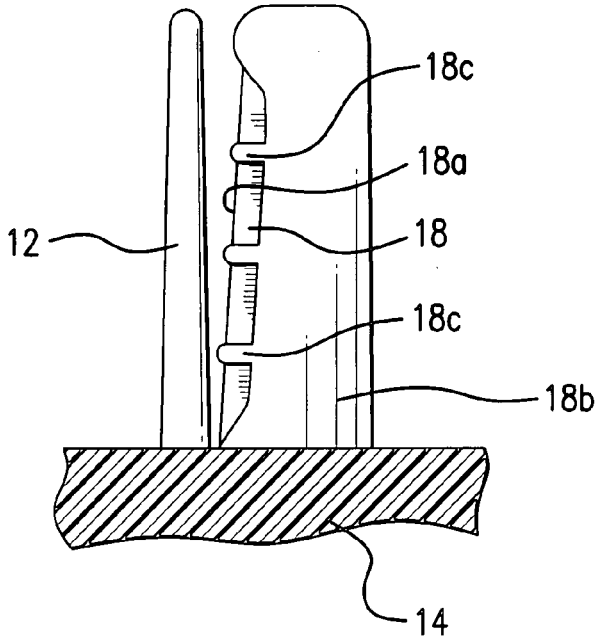
FIG. 2 is an expanded front view illustrating the main structure of the hair brush of the embodiment of the present invention.
Figure 4:
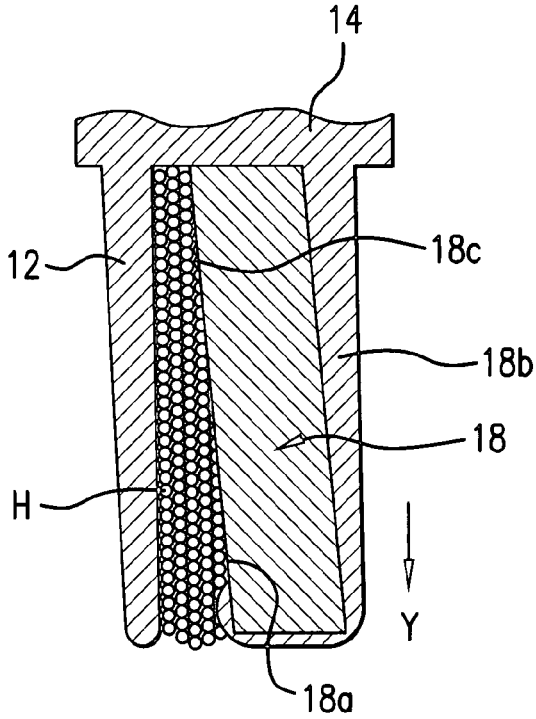
FIG. 4 is an expanded cross-sectional view illustrating the utilization mode of the hair brush of the embodiment of the present invention.
Figure 5:
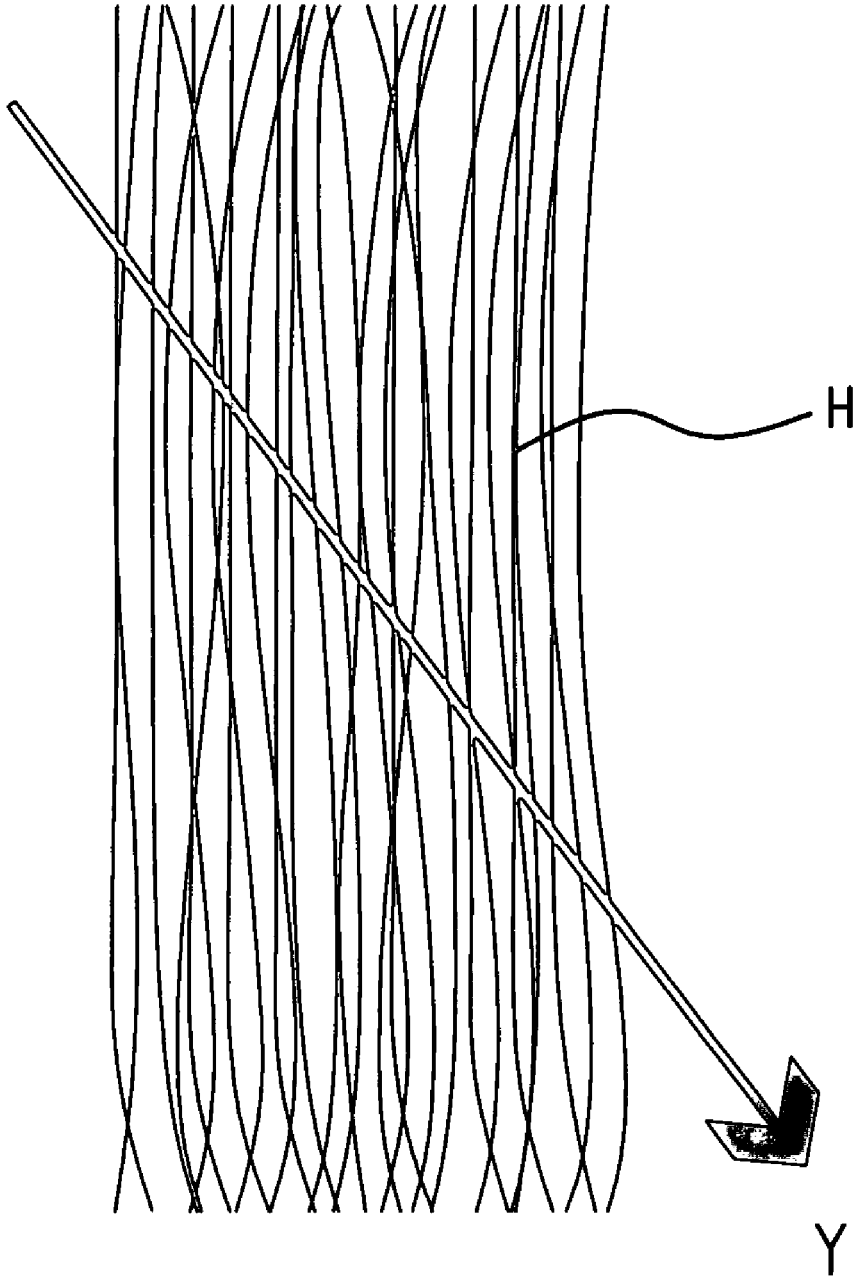
FIG. 5 is an explanatory drawing illustrating the principle of hair cutting with the cutter of the hair brush of the embodiment of the present invention.

In the basic configuration of the hair brush 10 in which the cutters 18 are fixed to the brush body 14, in the hair brush 10 in which multiple bristles 12 are set upright on the brush body 14, cutters 18 each provided with a cutting edge 18*a* are set upright nearby the above-mentioned bristles 12, and the cutting edges 18*a* of the cutters 18 are disposed so as to face the bristles 12 (see FIGS. 1, 2, and 4).

The hair brush 10 is composed, as any conventional hair brush, of the brush body 14 comprising the bristles 12 and a handle 16. The brush body 14 typically has an elongated shape and comprises long sides and short sides, but such a configuration is not limiting.

Furthermore, the inventor also planned a configuration in which the hair brush comprises no handle 16 and a configuration with brush body 14 of a shape other than an elongated shape.

Moreover, a handle may be provided rotatably or fixedly with respect to the brush body 14.

The position in which the handle is attached to the body 14 can vary as well known in the field of such hair brushes (see FIG. 1).

In the hair brush 10, multiple bristles 12 are provided, as in well-known hair brushes, on the lower surface of the brush body 14.

The present invention places no limitation on the arrangement of the bristles 12, and they may be arranged with a constant pitch in the row direction or with different pitches.

From the standpoint of production efficiency and cost and also taking into account the above-described body 14, it is preferred that the bristles 12 be from a plastic, but no specific limitation is placed on the material of the bristles. For example, as in well-known hair brushes, multiple animal bristles such as hog bristles can be bundled together to obtain units and multiple bristles are composed of multiple groups of such units.

Because the distal ends of the bristles 12 (at the scalp side at the time of use) are brought into contact with the human scalp T, they contribute to combing hair H and massaging the scalp T. Therefore, it is preferred that they be shaped to have a cross section in the form of a circular arc, which has an excellent buffering function, thereby making it possible to prevent the scalp T from being scratched and hurt (see FIGS. 1 through 4).

No limitation is placed on the shape of the bristles 12, but an elongated pin-like shape with a round lateral cross section is preferred, as is generally known.

The advantage of such bristles is that already available brushes and production equipment can be used.

Figure 3:
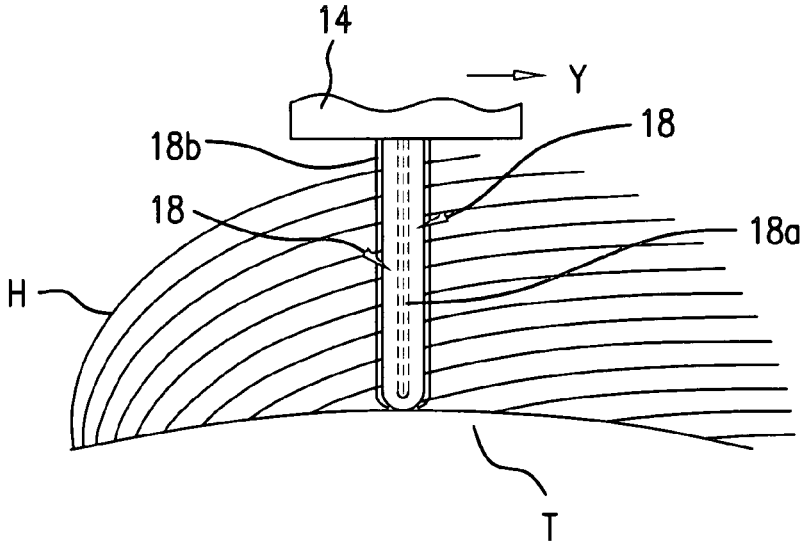
FIG. 3 is an expanded side view illustrating the utilization mode of the hair brush of the embodiment of the present invention.

Meanwhile, in accordance with the present invention, sheet-shaped the cutters 18 comprising the cutting edges 18*a* are set upright on the lower surface of the brush body 14 nearby the bristles 12 and hair H can be cut in a set bundled state (see FIG. 3 and FIG. 4).

When the cutters 18 are set upright nearby the bristles 12, providing the cutters 18 over the entire area of the brush body 14 generally creates the risk of cutting too much hair H. Therefore, it is generally sufficient to provide the cutters over a specific region of the brush body 14, as shown in FIG. 1.

However, with people having the especially thick hair or when cutting of a large amount of hair is conducted for a special purpose, it is not necessary to limit the arrangement of the cutters 18 to a specific region of the brush body 14.

In the case shown in the figure, five cutters 18 are provided from the center toward the distal end of the brush body 14, but no specific limitation is placed on the number or positions of the cutters.

It was explained that the cutters 18 are set upright nearby the bristles 12, but because the primary intention is to cut hair H introduced between the mutually adjacent bristles 12 and the cutters 18, it is preferred that the cutting edges 15*a* of the cutters 18 be disposed so as to face the adjacent bristles 12, as shown in FIGS. 1, 3, 4.

The cutters 18 that may have a sheet-like configuration comprising the cutting edge 18*a* on one side, as in a shaving blade, are provided with plastic covers 18*b* with an almost U-shaped cross section, the cutting edge 18*a* being installed inside the cover 18*b* so that the cutting edge 18*a* is exposed at the opening side of the cover 18*b*.

Installing the cutters 18 inside plastic covers 15*b* with an almost U-shaped cross section can be easily carried out by the insert molding process.

When the height of the cutting edges 18*a* of the cutters 18 is set to be roughly equal to the height of the bristles 12, because there is the risk of the cutting edges 18*a* of the cutters 18 hurting the scalp T when the cutting edges are brought into contact with the scalp T, covering the distal ends of the cutters 18 with plastic covers 18*b* can advantageously prevent the damage of scalp T, this protection being described below in greater detail.

The inventor has also planned that projections 18*c* slightly protruding beyond the extension line of cutting edge 18*a* in the direction perpendicular to the extension line of cutting edge 18*a* of cutter 18 be provided with a constant spacing in the cover 18*b* of cutter 18, as shown in FIGS. 2 and 4.

Projections 18*c* provide for increased strength of cover 18*b*. Moreover, because they are provided with a constant spacing, hair H introduced between the cutters 18 and the bristles 12 can be split by projections 18*c*, thereby eliminating the risk of excessive cutting of hair H.

The inventor has also planned that the height of the cutters 18 be set lower than the height of the bristles 12.

The cutters 18 are usually made from a metal material. Therefore, in the case of the present invention, the distal end side of cutter 18 is inevitably brought into contact with scalp T and scratches the scalp T when brush 10 is used.

Accordingly, the inventor attempted to create a configuration in which the distal ends of the bristles 12 are brought into contact with scalp T, but the distal ends of the cutters 18 are not brought into contact with scalp T, by setting high bristles 12 and low cutters 18.

A configuration in which the height of the cutters 18 is less than that of the bristles 12 is also planned, but in order to provide for safety of scalp T when the brush is used, a protective member for protecting the scalp T may be installed at the distal end of the cutters 18.

As described hereinabove, sheet-shaped cutters 18 comprising the cutting edges 18*a* are set upright on the lower surface of the brush body 14 nearby bristles 12. In accordance with the present invention, because hair H is introduced between the bristles 12 and the cutters 18 and at the time of use hair H is cut by bringing hair H into contact with cutting edges 18*a*, the cutting edges 18*a* of the cutters 18 face the bristles 12.

As described hereinabove, the conventional bristles 12 are set upright on the lower surface of the brush body 14, but the inventor has also planned that those bristles 12 that face the cutting edges 18*a* of the cutters 18 have a circular arc surface in the lateral cross section, as shown in the figure, and have a strength higher than that of other bristles 12.

The intention of the present invention is that hair H is introduced between the bristles 12 and the cutters 18 so as to be forcibly bundled therebetween, and the bundled hair is cut with the cutters 18. Therefore, by contrast with the conventional hair brushes that are used for the purpose of merely combing the hair or massaging the scalp, it can be expected that a concentrated stress will be applied to the bristles 12 facing the cutting edges 18*a* of the cutters 18. For this reason, bristles were employed that have a circular arc surface in the lateral cross section and a strength higher than that of other bristles 12.

An additional advantage of selecting the above-mentioned bristles 12 with a circular arc surface in the lateral cross section is that hair H at time of hair H introduction can be introduced smoothly.

It is preferred that bristles with an expanding cross section area or bristles from a material with superior strength be employed as the bristles 12 facing the cutting edges 18*a* of the cutters 18, as shown in the figures.

It can be also expected that, similarly to the bristles 12, a load will be applied to the cutters 18, but because the cutters from a metal material are usually used, this should cause no concerns. However, if necessary, the strength of the cutter can be increased.

It was described hereinabove that the cutting edges 18*a* of the cutters 18 face the bristles 12. In an even more preferred example, the cutting edges 18*a* of the cutters 18 are positioned on the extension line of the central axis line of the bristles 12.

The advantage of the cutting edge 18*a* being positioned on the extension line of the central axis line of the bristles 12 is that cutting of hair H can be conducted in a state close to the ideal state.

The inventor has also planned that the above-mentioned cutters 18 can be fixedly mounted on the brush body 14, and also that the cutters 18 can be attached to the brash body and detached therefrom to address the problem of usage-induced deterioration.

A specific example in which cutter 18 is provided so that that it can be attached to the brush body 14 and detached therefrom will be described below.

In the preferred embodiment of the present invention, the above-described cutters 18 and the bristles 12 are inclined so as to come apart gradually in the upward and outward directions and the distance between the cutters 18 and the bristles 12 increases. As a result, the amount of the hair introduced between the cutters 18 and the bristles 12 can be increased, thereby facilitating cutting of thick hair.

Further, because the bristles 12 adjacent to the cutters 18 on the side of the cutting edges 18*a* of the cutters 18 have at least a cross section in the form of a circular arc, hair H can be smoothly introduced between the cutters 18 and the bristles 12.

The angle of the hair brush 10 with respect to hair H at the time of use will differ significantly depending on the user's preference, combing position of hair H, and cutting position.

Furthermore, the angle with respect to hair H also will differ depending on whether the user is right-handed or left-handed.

This difference in the angle of the hair brush 10 with respect to hair H at the time of use obviously affects the inclination angle of the above-mentioned bristles 12 and especially the inclination angle of the cutting edges 18*a* of the cutters 18.

The inventor conducted an experimental study of the usage angle by taking into account differences in the above-described usage conditions.

The results of the study showed that when the case where hair H at the rear right side of the head is combed and cut by moving the hair brush 10 at an angle from the right side toward the neck with a right hand is considered as a standard case, the appropriate inclination angle is within a range of from 10 to 80 degrees, preferably 60 degrees, with respect to the central line of the brush body 14.

On the other hand, when combing and cutting hair H located at the rear left side of the head with the left hand is considered as a standard case, the appropriate inclination angle is symmetrical within a range of from 100 to 170 degrees, preferably 120 degrees, with respect to the central line of the brush body 14, this configuration being symmetrical with the above-described one.

It was explained hereinabove, that the aforesaid cutters 18 comprise plastic covers 18*b* with a U-shaped cross section, independently from the bristles 12, and the cutting edges 18*a* are installed inside those covers 18*b* so as to be exposed at the opening side of the covers 18*b*.

By contrast, in the present embodiment, instead of providing the covers 18*b* for the cutters 18, both bristles also serving as holding members for cutters 18 and bristles 12 not provided with the cutters 18 are set upright on the brush body 14, and the cutting edges 18*a* of the cutters 18 are arranged so as to face the bristles 12 that are not provided with the cutters 18. In this case, the object of the present invention can be also attained.

In other words, it can be said that the cutters 18 are provided on the bristles 12 themselves.

The present embodiment relates to a replaceable cutting unit 20 for a hair brush in which the cutter 18 can be attached to the brush body 14 and detached therefrom in accordance with the usage-induced deterioration of cutter 18 in the above-described the hair brush 10.

Because the only difference between this replaceable cutting unit 20 for a hair brush and the hair brush 10 in which the cutters 18 are fixedly attached to the brush body 14 is that the cutters 18 and the bristles 12 are provided on a cutting unit base 22, instead of attaching the cutters 18 to the brush body 14, in explanation of the configuration common to the hair brush 10 will be omitted.

Figure 15:
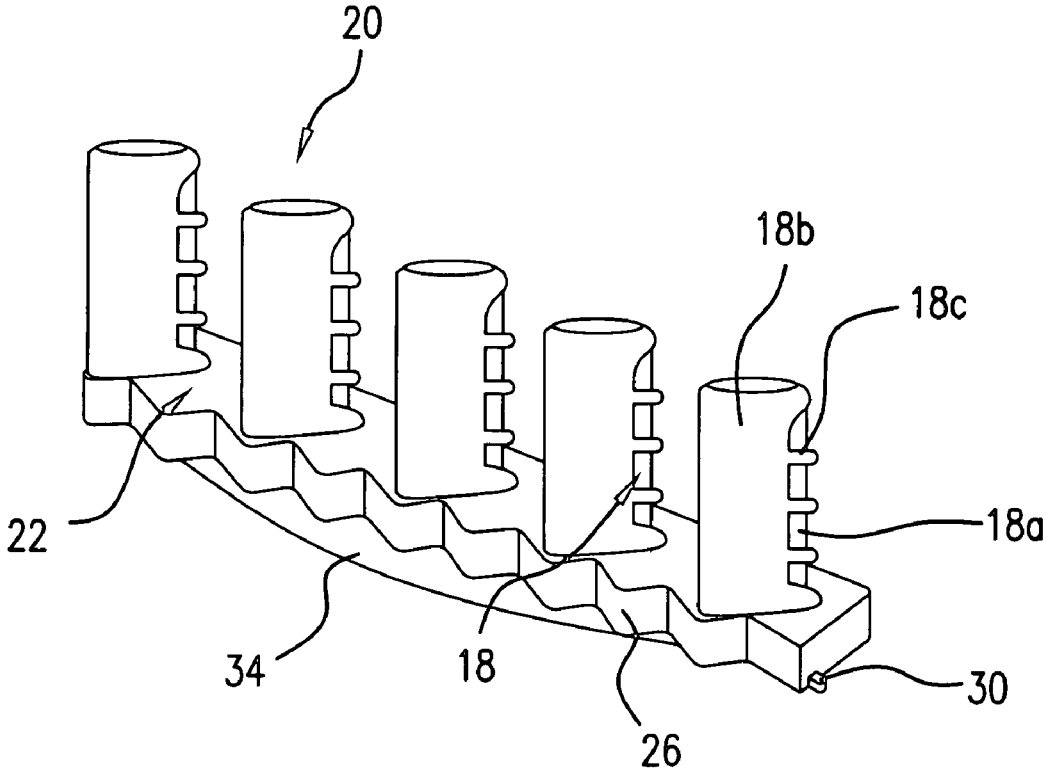
FIG. 15 is an oblique view of a replaceable cutting unit without bristles.

Furthermore, reference is also made to a replaceable cutting unit for a hair brush in which only a cutter is provided on the cutting unit base 22 (see FIG. 15).

Furthermore, the configuration of the brush body 14 for detachable attachment of the replaceable cutting unit for a hair brush will be also explained (see FIGS. 6 through 9).

In the replaceable cutting unit 20 for a hair brush, the bristles 12 are set upright on cutting unit base 22, the cutters 18 each comprising cutter edge 18*a* are set upright nearby the bristles 12, and the cutting edges 18*a* of the cutters 18 are arranged so as to face the bristles 12 (see FIGS. 6 through 9).

In the present embodiment, a total of five bristles 12 and five cutters 18 are provided, but the number thereof can vary as necessary, similarly to the above-described case of hair brush 10.

Figure 9:
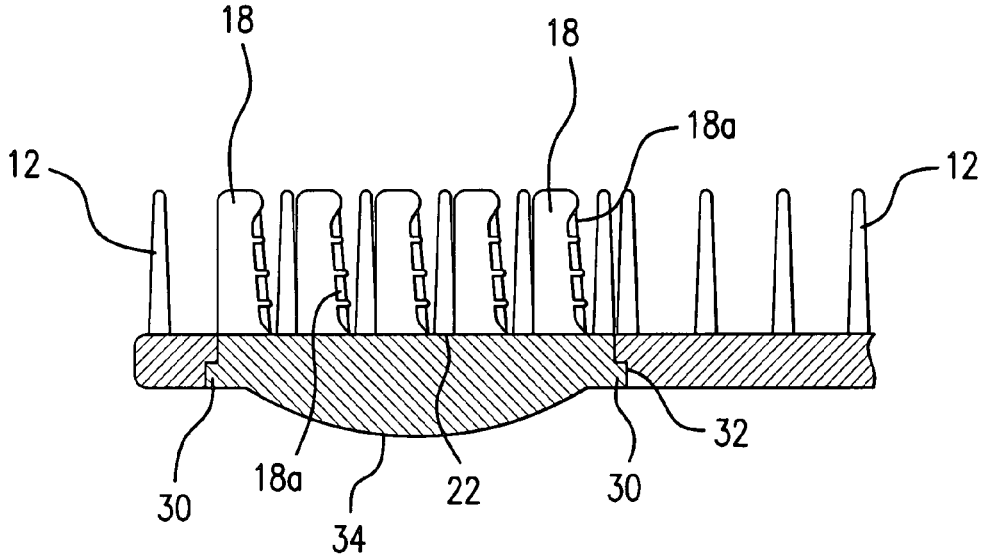
FIG. 9 is a partial expanded cross-sectional view illustrating the main structure of the hair brush of another embodiment of the present invention.
Figure 10:
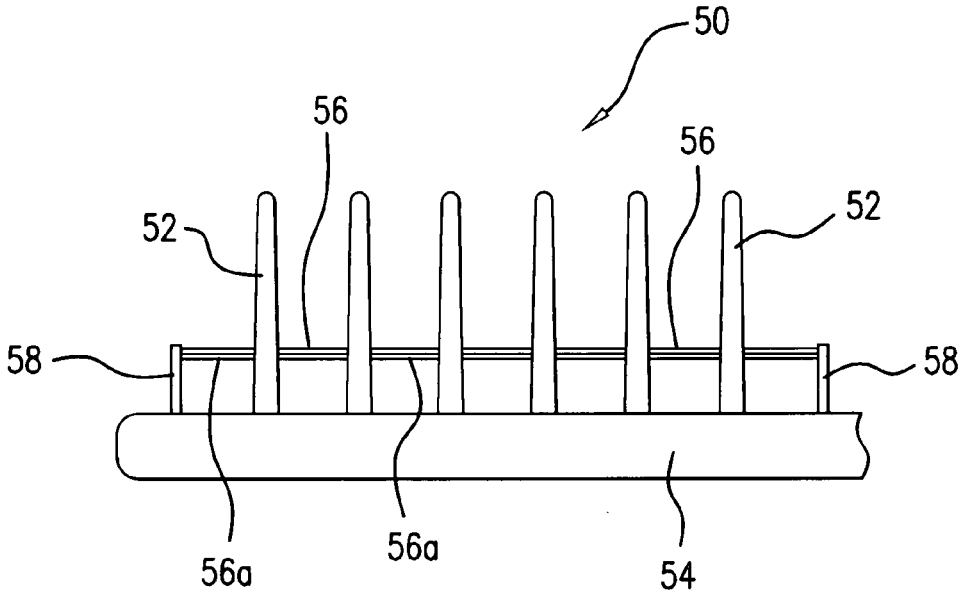
FIG. 10 is an expanded front view illustrating the main structure of the hair brush of another embodiment of the present invention.

Because the replaceable cutting unit 20 for a hair brush is provided so that it can be removably fit into the fitting hole 24 formed in the brush body 14, the cutting unit base 22 is shaped according to the shape of the fitting hole 24 (see FIG. 9).

Figure 6:
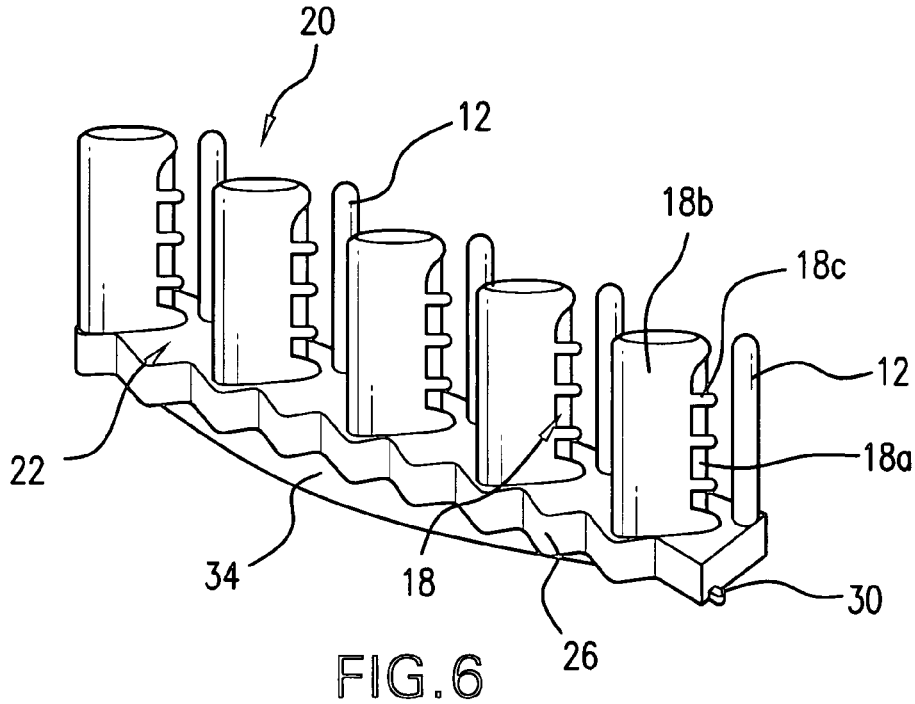
FIG. 6 is an oblique view of a replaceable cutting unit for the hair brush of the embodiment of the present invention.
Figure 7:
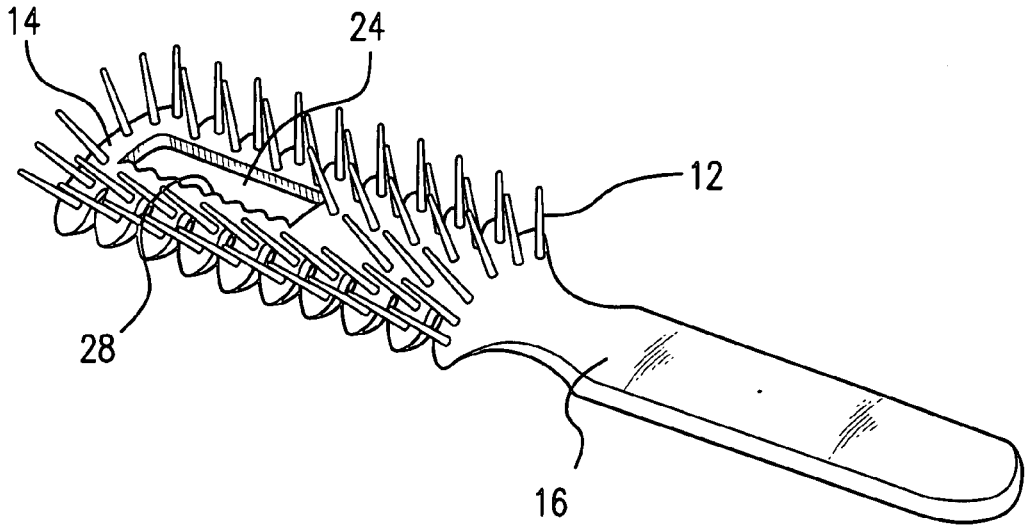
FIG. 7 is a perspective view illustrating the state before a replaceable cutting unit for a hair brush was installed on a hair brush body of another embodiment of the present invention.

More specifically, one side of the base 22 is formed as a wavy surface 26 comprising peaks and valleys, and one side of the fitting hole 24 of the brush body 14 is formed as a wavy surface 28 comprising peaks and valleys corresponding to the wavy surface 26 comprising peaks and valleys on one side of base 22 (see FIG. 6).

Furthermore, stoppers 30, 30 are formed on both sides in the longitudinal direction of the base 22.

On the other hand, mating steps 32 corresponding to the above-mentioned stoppers 30, 30 are formed at both sides of the opening of the fitting hole 24 in the surface side of the brush body 14 (FIG. 9).

The cutter 18 side of this replaceable cutting unit 20 for a hair brush is thus directed toward the lower surface from the front surface of the brush body 14, and the base 22 of the replaceable cutting unit 20 for a hair brush is fit into the fitting hole 24 of the brush body 14.

The wavy surface 26 of the base 22 is mated with the wavy surface of the fitting hole 24 of the brush body 14, and the stoppers 30, 30 provided in the base 22 of the replaceable cutting unit 20 for a hair brush are supported by mating step 32 of the brush body 14. As a result, the replaceable cutting unit 20 for a hair brush can be installed reliably, without backlash, in the brush body 14. The base 22 is provided with a handle 34 for removing the replaceable cutting unit 20 for a hair brush (see FIG. 9).

Figure 8:
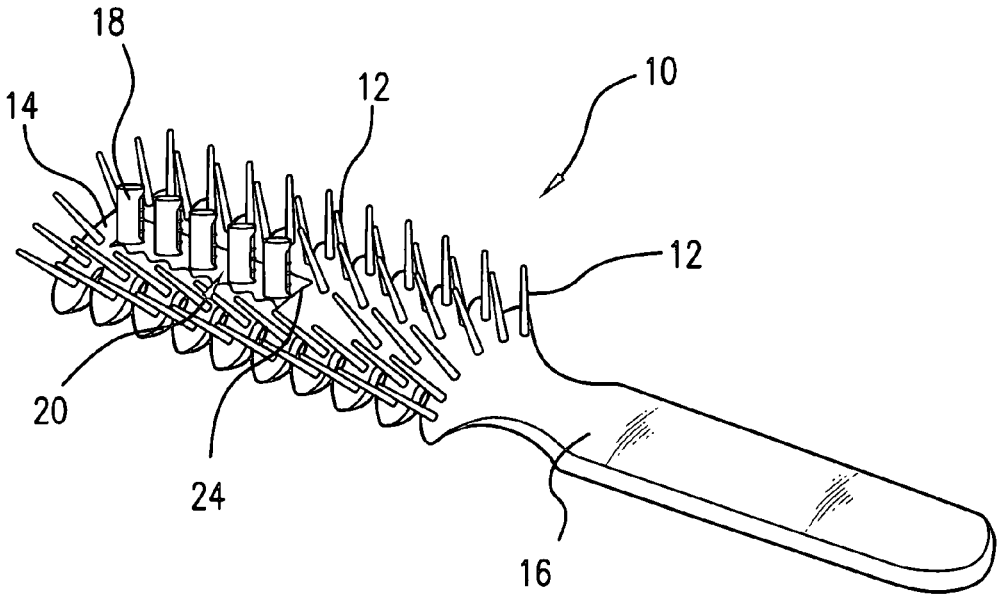
FIG. 8 is an oblique view illustrating the state after a replaceable cutting unit for a hair brush was installed on a hair brush body of another embodiment of the present invention.

When the cutting unit base 22 of the replaceable cutting unit 20 for a hair brush is thus fitted into the fitting hole 24 of the brush body 14, the cutters 18 each comprising cutting edge 18*a* are set upright nearby the bristles 12 in the hair brush 10 having multiple bristles 12 set upright in the brush body 14, and the hair brush 10 can be obtained in which the cutting edges 18*a* of the cutters 18 face the bristles 12 (see FIG. 8).

The advantage of the replaceable cutting unit 20 for a hair brush being a combination of the bristles 12 and the cutters 18 is that it can be used individually and independently from the brush body 14 as a tool for hair trimming.

On the other hand, in the above-described replaceable cutting unit 20 for a hair brush, the bristles 12 were combined with the cutters 18, a replaceable cutting unit for a hair brush in which the bristles 12 are omitted is also planned by the inventor.

A replaceable cutting unit can be obtained by setting the above-described cutters 18 upright independently from each other in the cutting unit base 22 (See FIG. 15). The cutters 18 are supported in covers 18*b* with an equal spacing between adjacent covers 18*b*.

In this case, because no bristles 12 are present, the cutters may be installed in a fitting hole by providing the fitting hole nearby the bristles 12 of the brush body 14.

When the cutting unit base of a replaceable cutting unit for a hair brush, which comprises no bristles, is thus fitted into the fitting hole of the brush body 14, the cutters 18 each comprising cutting edge 18*a* are set upright nearby bristles 12 in the hair brush 10 having multiple bristles 12 set upright in the brush body 14, and the hair brush 10 can be obtained in which the cutting edges 18*a* of the cutters 18 face the bristles 12.

In this case, it is preferred that cutting edges be disposed at the adjacent bristles 12 when the cutter is installed.

An example of the method for using the hair brush 10 of this embodiment of the present invention will be described hereinbelow with reference to the appended drawings.

This example of the method for using the hair brush is common to hair brushes of the above-described three types (1), (2), and (3).

The bristle 12 side of this brush 10 is directed toward hair H and moved along the scalp T (the direction shown by symbol Y in FIG. 3).

In this case, this movement is usually conducted along a smooth circular arc.

Obviously, following this movement, hair H is combed by multiple bristles 12 and the cutters 18. Moreover, on the scalp T side, that is, the excess hair H that is unwanted in terms of appearance and located in the lower layer of hair H, is introduced as a bundle in the space between the bristles 12 and the cutting edges 18*a* of the cutters 18 located close to the bristles (see FIGS. 3, 4).

In this case, the introduced bundled hair H group is introduced forcibly in a state in which it crosses the vertical line direction of the cutting edges 18*a* of the cutters 18 and part of hair H group close to the cutting edges 18*a* is brought into contact with the cutting edges 18*a* (see FIG. 4).

Furthermore, when the brush 10 is moved in the distal end direction of hair H (neck side of the human body), part of bundled hair H, that is, hair H group located close to the cutting edges 18*a* is cut, while hair H rubs against the cutting edges 18*a* (see FIG. 4).

Therefore, an advantage of the present invention is that hair H can be cut entirely from the root thereof, in other words, at the position close to scalp T where it is difficult for a person to cut by oneself.

Further, the cut hair H is released from the bundled state and falls down. However, following the movement of brush 10, hair H which is located generally at the lower side, that is, at the neck side of the human body is newly forcibly introduced between the above-described bristles 12 and the cutters 18.

On the other hand, the uncut hair H close to the cutting edges 18*a* is brought into contact with cutting edges 18*a*, as described above, and cut continuously.

Therefore, because the bristles 12 and the cutting edges 18*a* of the cutters 18 located nearby the bristles can be brought into contact with hair H of the lower layer, that is, at the scalp T side, hair H at the scalp T side can be also combed by the bristles 12 and cut.

Figure 11:
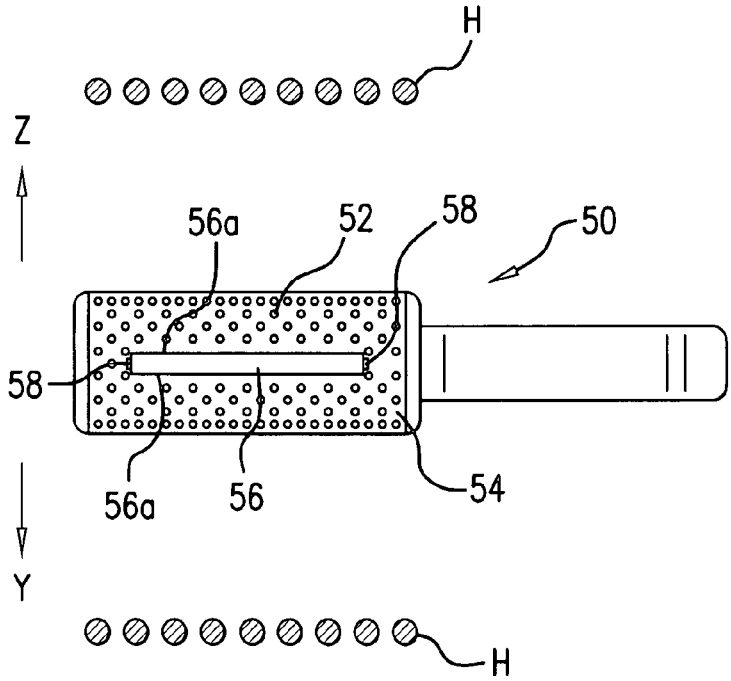
FIG. 11 is a partial expanded plan view illustrating the main structure of the hair brush of another embodiment of the present invention.
Figure 12:
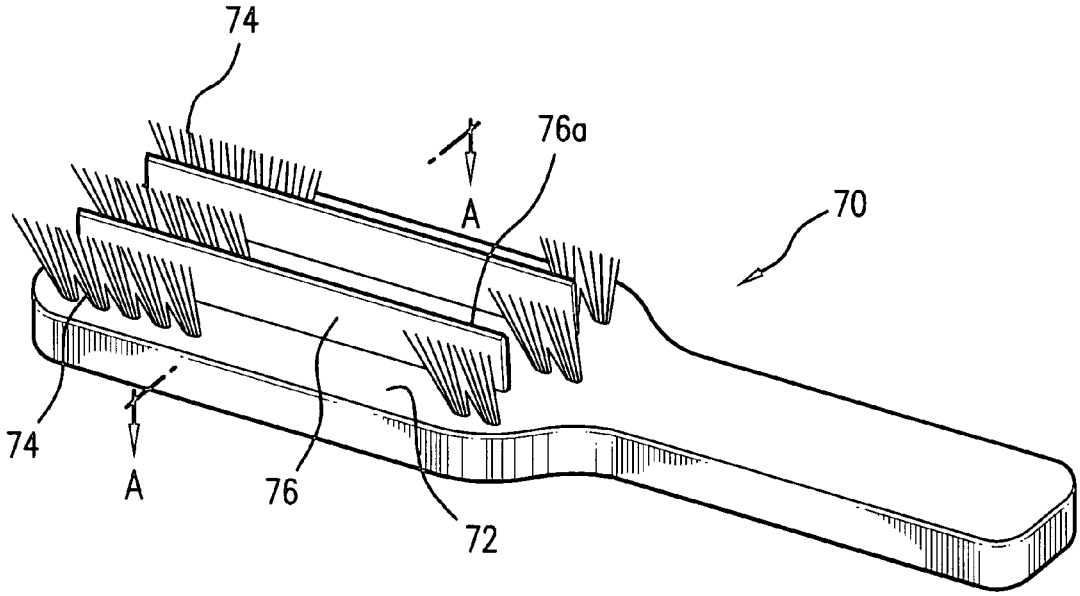
FIG. 12 PRIOR ART
FIG. 12 is a perspective view illustrating the prior art technology.
Figure 13:
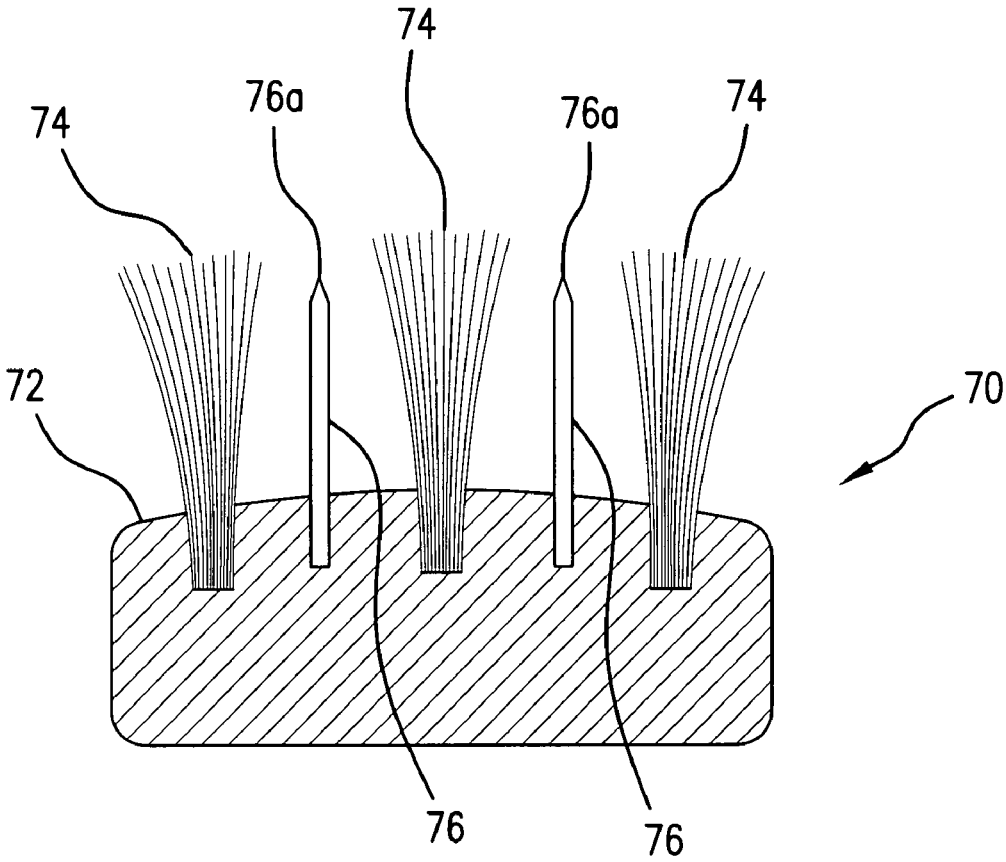
FIG. 13 PRIOR ART
FIG. 13 is a cross-sectional view along the A-A line in FIG. 12.
Figure 14:
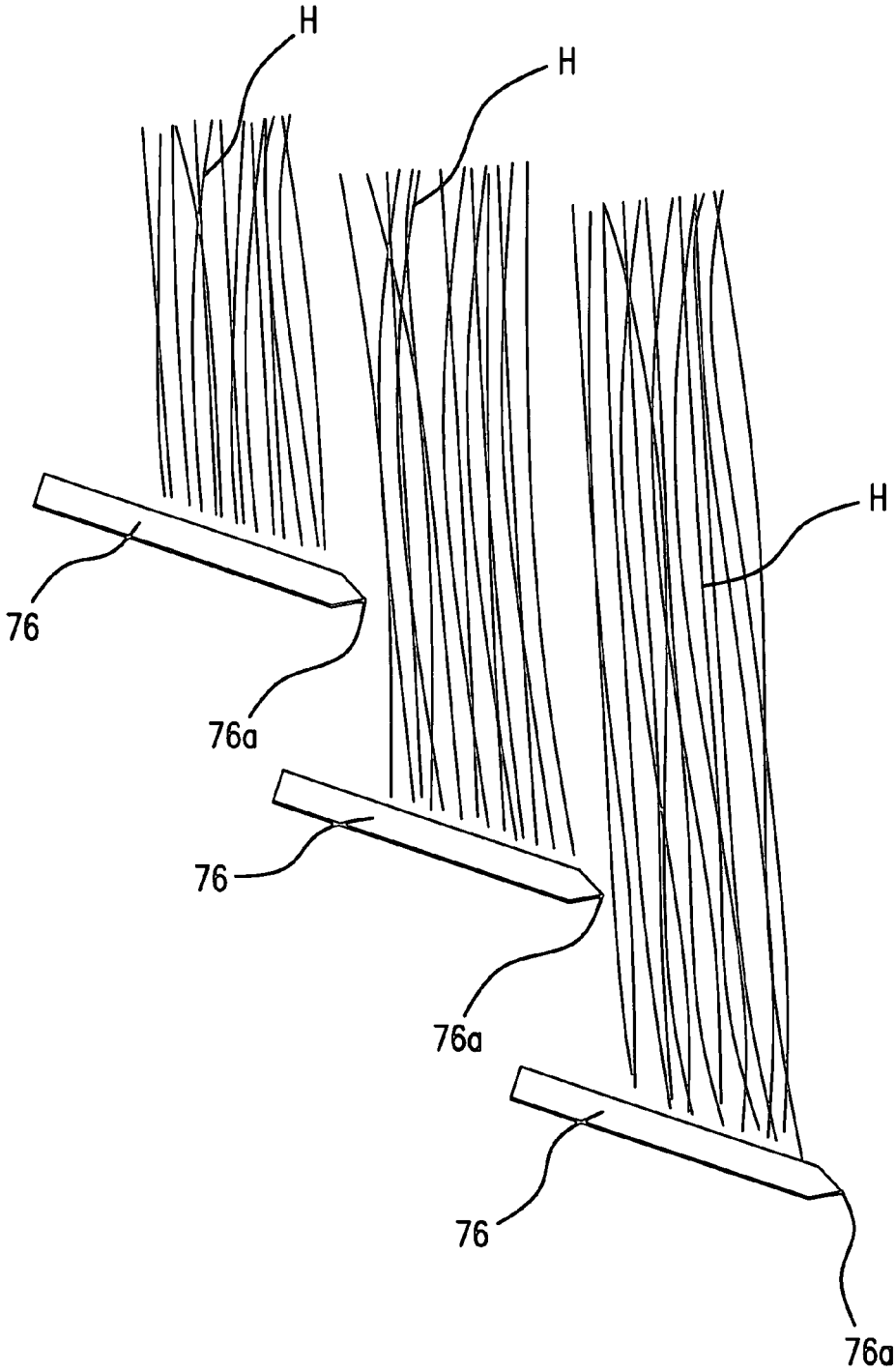
FIG. 14 PRIOR ART
FIG. 14 is an explanatory drawing illustrating the principle of hair cutting with the cutter of a hair brush representing the prior art technology.

Two other hair brushes 50 representing the preferred embodiments of the present invention will be described below (FIGS. 11 and 12).

In this preferred embodiment, similarly to the above-described preferred embodiment, the following hair brushes will be considered: (4) a hair brush 50 in which a cutter 56 is fixed to a brush body 54, (5) a hair brush 50 in which a replaceable cutting unit for hair brush comprising the bristles 12 and cutter 56 is provided so that it can be attached to brush body 54 and removed therefrom, and (6) a hair brush 50 in which a replaceable cutting unit for hair brush comprising only a cutter 56 is provided so that it can be attached to brush body 54 and removed therefrom.

In the hair brush in which multiple bristles 52 are set upright on brush body 54, the cutter 56 is provided among bristles in a prescribed region of brush body 54, the height of this cutter being less than that of bristles 52.

Further, cutting edges 56*a* of the cutter are directed outward from the brush body 54 and disposed so as to be separated from brush body 54.

More specifically, a pair of support members 58 for a cutter are set upright at both sides of the brush body 54, and the cutter 56 is installed horizontally so as to stretch between the upper sides of this pair of support members 58 for a cutter.

In this case, cutting edges 56*a* are provided at both side ends of the cutter 56, but it is not necessary to provide cutting edges at both sides, and a cutting edge can be provided at one side only.

Usually, the cutter 56 can have a sheet-like shape, and the cutting edges 56*a* are directed outward of the brush body 54 by setting the cutter 56 in a separated state at a prescribed distance from brush body 54.

In addition, the cutter 56 shown in the figures is shown in a horizontal state; however, the inventor also plans a configuration such that the cross-sectional shape describes a mountain, and a space is formed on both sides of the cutter.

Basically, the configuration in which a replaceable cutting unit for a hair brush comprising the bristles 12 and cutter 56 is provided so that it can be attached to brush body 54 and detached therefrom and the configuration in which a replaceable cutting unit for hair brush comprises only the cutter 56 may be completely identical to the configurations of the above-described embodiment, and the explanation thereof can be conducted with reference to those configurations.

An example of the method for using the hair brush 50 of this embodiment of the present invention will be described hereinbelow with reference to the appended drawings.

The bristle 52 side of this brush 50 is directed toward hair H and moved along the scalp T (the direction shown by symbol Y or direction Z in FIG. 11).

Cutting edges 56*a* of cutter 56 are directed at a right angle to hair H positioned at the scalp side, and the cutter 56 moves at a Tight angle to hair H positioned at the scalp side, following the movement of the cutter 56. As a result, not only hair H is cut effectively, but also hair H can be combed.

In this example, the cutter 56 is in a separated state at a prescribed distance from the brush body 54. Therefore, the cut hair H falls down in any of the empty spaces formed above and below the cutter 56 serving as a boundary therebetween. As a result, the space between the bristles is not clogged by hair H.

10 HAIR BRUSH
12 BRISTLES
14 BRUSH BODY
16 HANDLE
18 CUTTER
18*a* Cutting Edge of Cutter
18*b* Cover of Cutter
18*c* PROJECTION
20 Replaceable Cutting Unit for Hair Brush
22 CUTTING UNIT BASE
24 FITTING HOLE
26 WAVY SURFACE OF CUTTING UNIT BASE
28 WAVY SURFACE OF BRUSH BODY
30 STOPPER
32 MATING STEP
34 HANDLE
50 HAIR BRUSH
52 BRISTLES
54 BRUSH BODY
56 CUTTER
56*a* CUTTING EDGE
H HAIR
T SCALP

What is claimed is:

1. A replaceable cutting unit for hair dressing comprising:

a cutting unit base that has a length, a width and a thickness, and is designed to fit in recess of a tool for hair dressing, the length and width forming a first surface on a top of the cutting unit base and a second surface on a bottom of the cutting unit base, at least three cutters that are set upright on and perpendicular to the surface of the cutting unit base with a cutting edge of each of the cutters being perpendicular to the first surface, each of the cutters extending in a respective plane parallel to but not co-planar with a plane of another of the cutters, wherein:

each of the cutters is supported in a cover with an equal spacing between adjacent covers, the covers extend from the first surface in the upright direction, and each of the covers extends beyond an end of the cutters that is located opposite from the cutting unit base, the cutters are installed inside the covers so as to have the cutting edge exposed at an opening in a side of each of the covers, the at least three cutters are disposed in a line extending along the length of the cutting unit base and an inclination angle of the plane of each of the cutters with respect to the line is within a range of 10 to 80 degrees, the length and thickness form a third surface on a third side of the cutting unit base, the third side including irregularities to mate with irregularities in the recess, the width and thickness forming a fourth surface on an end of the cutting unit base, the end including a stopper to aid in retaining the cutting unit base in the recess, and a handle is included on the second surface to aid in extracting the cutting unit base from the tool for hair dressing.

2. A replaceable cutting unit for hair dressing according to claim 1, wherein the inclination angle is 60 degrees.

3. A replaceable cutting unit for hair dressing according to claim 1, wherein the cover has an approximately U-shaped cross section, and wherein projections protruding slightly beyond the cutting edge in a direction perpendicular to the cutting edge are provided with an equal spacing between the projections.

4. A replaceable cutting unit for hair dressing according to claim 1, wherein the third surface has a waved shape.

5. A replaceable cutting unit for hair dressing according to claim 1, wherein the tool for hair dressing is a hairbrush.

6. A replaceable cutting unit for hair dressing according to claim 1, wherein the tool for hair dressing comprises a tool for hair trimming when the replaceable cutting unit is fitted in the tool for hair dressing.

* * * * *